US007945972B2

(12) United States Patent
Brescia

(10) Patent No.: US 7,945,972 B2
(45) Date of Patent: May 24, 2011

(54) SUPPORT FOR WALL MOUNTED TOILETS

(76) Inventor: Onofrio Brescia, Norridge, IL (US)

( * ) Notice: Subject to any disclaimer, the term of this patent is extended or adjusted under 35 U.S.C. 154(b) by 1384 days.

(21) Appl. No.: 11/450,508

(22) Filed: Jun. 9, 2006

(65) Prior Publication Data

US 2006/0277673 A1 Dec. 14, 2006

Related U.S. Application Data

(60) Provisional application No. 60/689,323, filed on Jun. 10, 2005.

(51) Int. Cl.
*E03D 11/00* (2006.01)
*E03D 11/14* (2006.01)

(52) U.S. Cl. ..... 4/252.1; 4/252.2; 4/252.3; 248/188.4; 248/188.6

(58) Field of Classification Search ..... 4/252.1–252.3, 4/592–594, 645; 248/188.4
See application file for complete search history.

(56) References Cited

U.S. PATENT DOCUMENTS 824,525 A * 6/1906 Bonney ..... 248/188.4
1,531,253 A * 3/1925 Kaufman ..... 4/252.2
1,855,024 A * 4/1932 Levin ..... 4/252.2
2,428,462 A * 10/1947 Kersten ..... 4/312
4,979,239 A 12/1990 Klein et al.
5,028,024 A 7/1991 Welles
5,107,638 A 4/1992 Unertl
5,628,484 A * 5/1997 Lechuga ..... 248/188.4
6,585,213 B1 * 7/2003 Olivier ..... 248/188.4
6,889,392 B1 5/2005 Karnopp et al.
6,979,240 B1 * 12/2005 Barton ..... 440/7
2005/0091733 A1 5/2005 Wright et al.
2005/0183193 A1 8/2005 Karnopp et al.
2005/0268390 A1 12/2005 Wright

OTHER PUBLICATIONS

James W. Harrell et al., Big Challenge designing for the needs of bariatric patients, Health Facilities Management, Mar. 2004, pp. 34-38, Health Forum, Inc., United States.

* cited by examiner

*Primary Examiner* — Tuan N Nguyen
(74) *Attorney, Agent, or Firm* — Matthew J. Raymond

(57) ABSTRACT

A support platform for wall mounted toilets is described. The platform attaches easily under the toilet and contains bolts and feet for adjustment. The platform provides support to wall mounted toilets so that persons of weight greater than the rated load of the wall mounted toilet can use the toilet in comfort and safety. It is removable for use in different bathrooms, easily transported and can be sterilized where bacterial or viral contamination is a concern.

9 Claims, 6 Drawing Sheets

SUPPORT FOR WALL MOUNTED TOILETS

CROSS-REFERENCE TO RELATED APPLICATIONS

This application claims the benefit of U.S. Provisional Application No. 60/689,323 filed on Jun. 10, 2005, which is incorporated by reference in its entirety.

FIELD OF THE INVENTION

The instant invention relates to supports for installed toilets. In particular, the instant invention relates to adjustable, portable, removable platforms for wall mounted toilets which allow additional weight to be supported. More particularly, the instant invention relates to floor supports for wall mounted toilets in hospitals and other health care facilities, where the toilet may be used by overweight, obese and extremely obese patients.

BACKGROUND OF THE INVENTION

The invention relates to a support platform for wall mounted toilets, particularly to support the additional weight placed on the toilet by overweight, obese or severely obese individuals.

Although there are many types of toilets, those used in hospitals, clinics and other health care facilities, nursing homes and assisted living facilities, weight loss clinics, gyms, office buildings and other related buildings are often wall mounted. Part of the reason for mounting to the wall is to make cleaning easier as this type of toilet leaves a space between the floor and the bottom of the toilet. Frequently, wall mounted toilets are located in bathrooms where a floor drain is available so that the entire floor can be washed and drained easily without having to hold the wash water in a container. Where the toilet is floor mounted, cleanliness at the interface of the toilet and the floor is not assured and bacteria from urine and fecal matter are not always eliminated by normal cleaning procedures. In hospital rooms, clinics, recovery rooms and nursing homes, this is of particular concern as patients may be immune compromised and subject to secondary or hospital acquired infections from bacterial and viral contamination.

Wall mounted toilets are typically rated for a normal sized patient; 350 pounds is a common weight limit for such fixtures. With the increase in obesity in the United States and other nations, there is a high likelihood that an overweight, obese or severely obese individual will use a wall mounted toilet somewhere in the facility. With a limit in the rated weight bearing capacity of the toilet, there is a risk that the toilet mountings will fail and the overweight, obese or severely obese individual will fall. Any fall by such an individual, particularly one where a toilet fixture breaks away from a wall or one where the porcelain breaks, could lead to an injury. Furthermore, there is a risk of damage to the bathroom which can be costly to repair. The issue is of sufficient concern that Harrell and Miller discuss hospital design for bariatric patients and suggest the need for a bariatric toilet seat support (Health Facilities Management, March 2004, pp 34-38).

Current techniques to alleviate this problem in hospitals use wooden supports as a wedge between the wall mounted toilet and the floor. These supports are not easily adjustable. Their composition is not easily cleaned and can become contaminated with microorganisms such as *E. coli* which is commonly found in bathrooms.

In response to this problem, BAR Industries (Adairsville, Ga.) has developed the SK1000 series toilet support. The support is described in two pending and published US applications, U.S. Ser. No. 11/205,666 to Wright and U.S. Ser. No. 10/701,812 to Wright et al. This support is designed to be mounted using the wall mounts for the toilet and is adjustable using a screw type bumper positioned close to the front of the toilet. It cradles the bottom of the fixture with an arm-like single support and attaches integrally to the wall mounting bolts. The device described in the '666 and '812 applications can be used by each toilet design. Since the BAR Industries toilet support is attached at the wall mounts, it is more difficult to remove or move to a new location. This permanency makes cleaning and repairing the fixture or floor more difficult. It also increases the number of units required by a hospital by reducing the ability to move the fixture to a new bathroom. As the number of units purchased increases, the cost advantage claimed by the manufacturer decreases. Since the SK1000 uses a single bumper style foot, all of the weight of the user is held by the single foot. If the single foot fails under the load (as could occur over time and through exposure to loads), the device will no longer provide support and the toilet could still break away from the wall. Finally, the installation of the SK1000 requires removal of the mounting bolts contained on the toilet. This can cause the toilet to break its seal and can create a leak. These deficiencies make the SK1000 undesirable as a mobile and interchangeable support.

Another company, DB Industries (Little Suamico, Wis.) has developed a Bariatric Toilet Seat Support (BTSS) as described in U.S. Pat. No. 6,889,392 to Karnopp et al and published U.S. application Ser. No. 11/057,793. This support is a four legged stand made of stainless steel which is inserted between the toilet seat and the bowl. It is designed to provide additional weight bearing capacity on the toilet seat itself and not specifically on the fixture. The four legs are adjustable providing for the ability to match any unevenness in the floor. It also provides vertical adjustment with two stainless steel threaded rods with rubber end caps that are fit to the wall behind the toilet. Locking nuts are used at all six adjustable arms or legs. The device is very large and although the manufacturer claims that it takes up little room, it is cumbersome to position, use and maintain. It is also made from a complex series of components leaving multiple opportunities for stress failure. As it is placed between the toilet seat and the bowl, there is a risk that the seat may break under the weight of the bariatric patient. Furthermore, because the unit is positioned underneath the toilet seat and is exposed to the water, there is a higher risk of contamination by fecal matter and/or bacteria. This creates a need for more frequent cleanings than the instant invention. The BTSS is also too large to be heat sterilized in a standard hospital autoclave. Finally, the BTSS does not fit all wall hung toilet models and the company offers customized manufacturing.

Other devices designed for toilets are typically wall mounts that are used at the time of construction. See for example, U.S. Pat. No. 5,107,638 to Unertl which shows a permanent mounting means for a wall mounted water closet fixture. These devices are not specifically designed for bariatric use, but simply as further methods for securing wall mounted elements of the toilet assembly. These devices are permanent attachments to the toilet or its tank and cannot be easily moved. They are ideally used at installation or during renovation of the bathroom and not ideal for use on an existing wall mounted toilet

BRIEF SUMMARY OF THE INVENTION

In view of the descriptions above and the deficiencies contained therein, the present invention can provide a platform to support wall mounted toilets, so that the weight capacity of the toilet is increased.

The present invention can further provide a removable and portable platform to support wall mounted toilets.

The present invention can also provide adjustment capability to the platform, so that the platform will support a wall mounted toilet independent of the height of the toilet.

The present invention can yet further provide a platform for a wall mounted toilet that is easy to position and adjust and does not require tools to use.

The present invention can embody a platform for wall mounted toilets that can be easily cleaned and sterilized.

The present invention can also provide a platform for wall mounted toilets that is easily transported and lightweight.

Other embodiments, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Described herein is a bariatric support for a wall mounted toilets that is lightweight, is easily removed for cleaning or transfer to a new bathroom and is adjustable to any wall mounted toilet design. The toilet support can be sterilized chemically using common disinfectants or through heat, steam or high pressure. It is compact in design and can be easily stored in limited spaces. It has a small number of parts and uses high quality interchangeable components.

Figure 1:
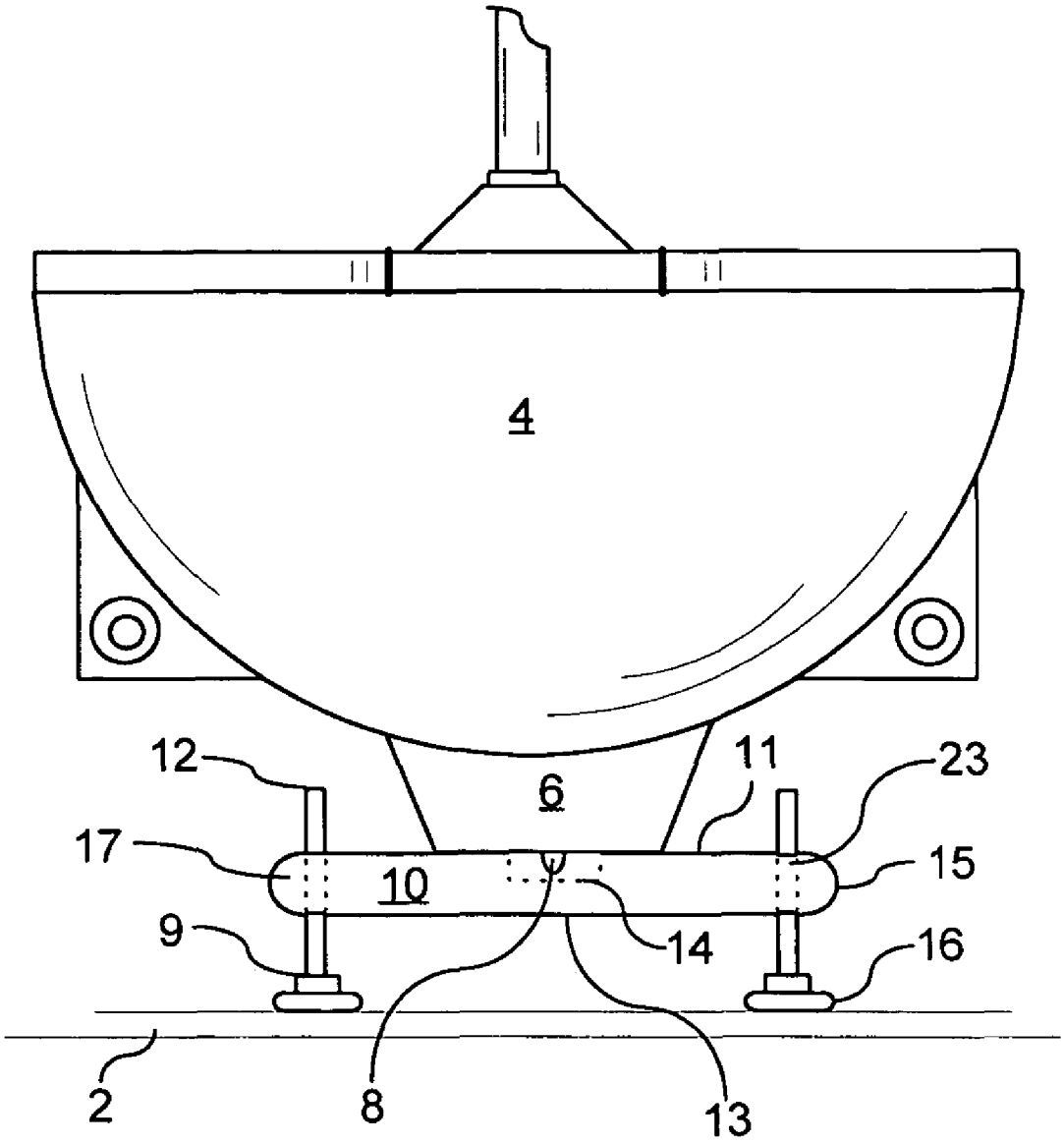
FIG. 1 shows a perspective view of the toilet support in use with a wall mounted toilet.

Referring now to the drawings, in FIG. 1 a front perspective view of the preferred toilet support apparatus as it is placed between the floor 2 and a wall mounted toilet 4. The lower section 6 of the wall mounted toilet 4 is commonly configured either in a flat or a curved shape. In FIG. 1, the lower section 6 is flat. Accordingly, the toilet support is shown with a platform 10 having a top surface 11 and a bottom surface 13 spaced by an outside edge 15 having a thickness 17. The platform 10 also has adjustable base members 9 comprising mounting bolts 12 and feet 16. In this perspective, only two mounting bolts 12 and feet 16 are shown but four are the preferred number spaced around the corners of the platform 10. A threaded bore 23 is drilled into the platform 10 and the mounting bolts 12 of the adjustable base members 9 are inserted through the threaded bore 23. The adjustable base members 9 can be made of any suitable material with a preferred design of stainless steel. The adjustable base members 9 can be adjustable glides or snap lock leveling mounts. The mounting bolts 12 can be of any height with the desirable height sufficient to raise the platform 10 such that it connects the bottom portion of the toilet. Mounting bolts 12 of multiple heights can be used depending on the space between the floor 2 and wall mounted toilet 4. It is desirable to have at least two inches of each mounting bolt 12 remain above the top surface 11 of the platform 10. The adjustable base members 9 are arranged around the platform 10 such that any portion of a mounting bolt 12 projecting above the top surface 11 of the platform 10 will not touch any surface of the wall mounted toilet 4. Each adjustable base member 9 has a weight bearing capacity of at least 250 pounds with a preferred capacity of 500 pounds. The adjustable base members 9 may have greater weight bearing capacity if desired. Adjustable glides or snap lock leveling mounts can be found through multiple sources, one example is the Monroe Company (Auburn Mills, Mich.). The number of adjustable base members 9 is at least four although it can be five or more depending on the design of the toilet support apparatus. A groove 14 is cut into the platform 10 to accommodate a nipple 8 commonly found on the lower section 6 of the wall mounted toilet 4. The nipple 8 is a common artifact of the molding process. The groove 14 is at least one-eighth inch deep in the platform 10 so that the nipple 8 does not make contact with the platform 10 while the lower section 6 of the wall mounted toilet 4 establishes direct contact with the top surface 111 of the platform 10. To use the device, the platform 10 is placed under the wall mounted toilet 4 with the groove 14 directly under the nipple 8. The adjustable base members 9 are adjusted by hand to raise the platform until it makes contact with the lower section 6 of the toilet 4. Once all adjustable base members 9 have been adjusted and the platform 10 contacts the lower section 6, the adjustable base members 9 can be adjusted using a wrench to make a firm contact between the platform 10 and the toilet 4.

Figure 2:
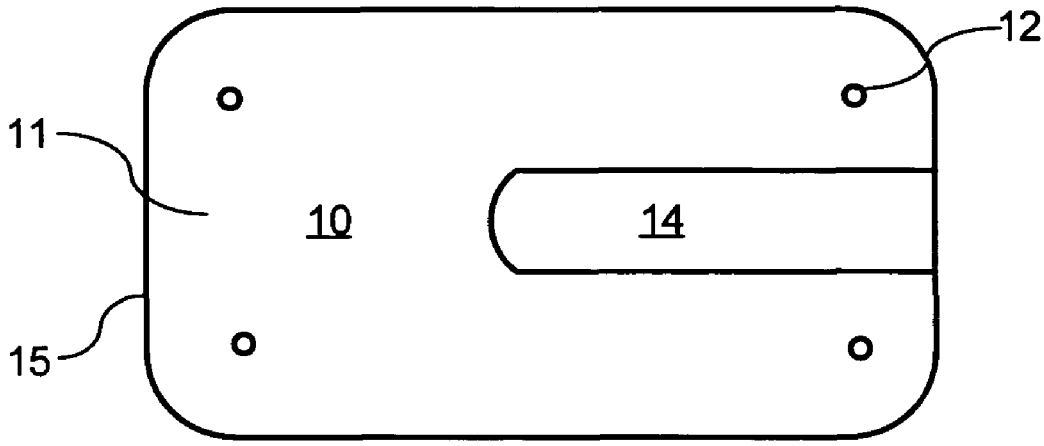
FIG. 2 shows a top view of the toilet support.

In FIG. 2 a top view of the preferred toilet support apparatus is provided. A platform 10 is shown having a top surface 11 and an outside edge 15 with four mounting bolts 12. The platform 10 is preferably made of aluminum block but can be made from steel, including stainless steel or surgical steel. Other high strength metals that can be sterilized by heat, pressure or chemicals can be used. The platform 10 is at least three quarters of an inch thick and can be of greater thickness depending on the starting material. The mounting bolts 12 are part of the adjustable base members (not shown) which are preferably adjustable glides placed at even intervals near the corners of the platform 10. Adding at least four mounting bolts 12 allows the force to be distributed among them so each mounting bolt 12 is carrying a portion of the load and not the full force or weight. If a single mounting bolt 12 failed, the remaining adjustable base members will distribute and support the load. The mounting bolts 12 are added by drilling threaded bores (not shown) in the platform 10 to match the diameter of the mounting bolts 12. The mounting bolts 12 are threaded to accommodate a securing device such as a nut and so they can be inserted into the threaded bores (not shown). The mounting bolts 12 are interchangeable and can be of different thread lengths and total heights depending on the needs of the support and the layout of the bathroom floor. The mounting bolts 12 can have optional flat or Philips head screwdriver notches on their top surface. The groove 14 is cut into the platform 10 to a preferred depth of one quarter inch and a preferred width of two inches. The depth and width of the groove 14 can be varied depending on the dimensions of the wall mounted toilet. The groove 14 extends from the front edge of the platform 10 to a distance of two thirds of the length of the platform 10. The corners of the platform 10 are preferably rounded to avoid sharp edges. The top and bottom edges of the platform 10 can also be rounded to avoid sharp edges.

Figure 3:
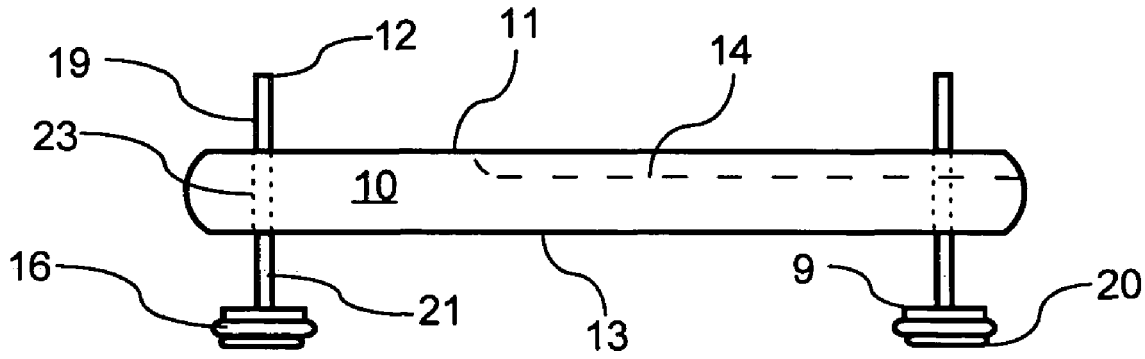
FIG. 3 shows a front side view of the toilet support.

In FIG. 3, more detail is shown through a side view of the toilet support apparatus. The platform 10 and the mounting bolts 12 are shown. A threaded bore 23 is drilled into the platform 10 to provide space for the mounting bolts 12. Now visible are the adjustable base members 9 comprised of feet 16 connected to the mounting bolts 12. Each mounting bolt 12 has a top portion 19 extending from the top surface 11 of the platform 10 and a bottom portion 21 extending from the bottom surface 13. The feet 16 stabilize the toilet support apparatus and provide weight bearing capability. The adjustable base members 9 raise or lower the platform 10 so that the top surface 11 of the platform 10 fits snugly under the wall mounted toilet. Each adjustable base member 9 can be adjusted manually to correct for any slope in the bathroom floor. This is particularly important in hospital bathrooms and nursing home bathrooms where a drain in the floor may exist to allow for easier cleaning. The feet 16 can be made of the same material as the mounting bolts 12 and the platform 10. Covers or pads 20 made of rubber, Teflon, plastic or another appropriate substance can be added to provide a non-slip and/or non-marring surface if desired. These covers or pads 20 are preferably removable and replaceable although they can be fixed and permanent if made of an appropriate inert substance such as polyethylene or Teflon that is capable of chemical sterilization. The feet 16 can be configured to have covers or pads 20 on none, all or some of the feet 16 as desired.

In an alternate embodiment, a securing member can be added to the mounting bolts 12. The mounting bolt is then threaded into the threaded bore 23 in the platform 10 so that the securing member sits just below the platform 10. The securing member is maintained in a loosened position under the platform 10 while the adjustable base member 9 is raised or lowered to fit the platform 10 under the toilet. A wrench can be used to snugly tighten the securing member against the bottom surface 13 of the platform 10 after it has been placed under the wall mounted toilet to provide further security for the platform 10. In yet another alternate embodiment, securing members can be added above and below the platform 10 on the mounting bolts for further security. The securing members are preferably nuts and can be regular hex nuts or lock nuts of a size that matches the mounting bolts 12. Washers can be used to further add security between the securing member and the bottom surface 12 of the platform 10. Both the nut and the washer are made from materials similar to the platform 10 with a preferred embodiment of stainless steel.

Figure 4:
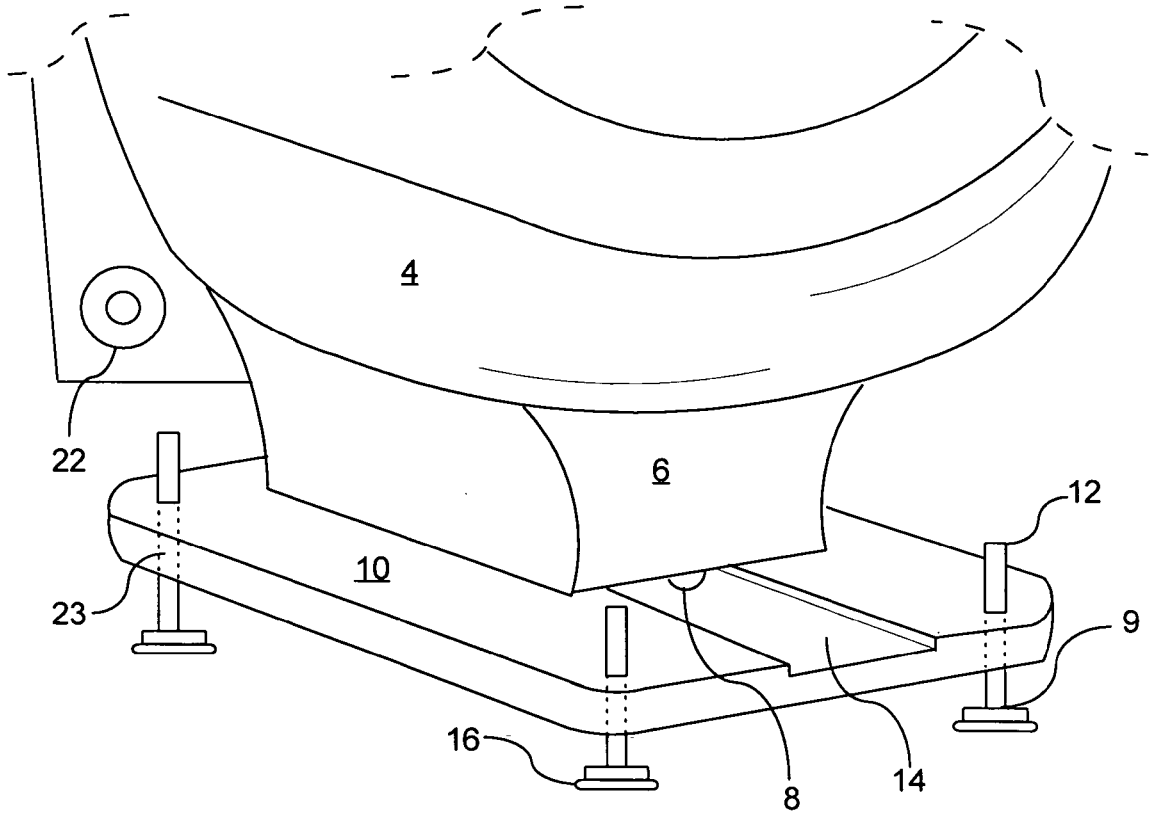
FIG. 4 shows an oblique view of the toilet support as it is placed under a partial view of a wall mounted toilet.

In FIG. 4, a lateral oblique view of the toilet support apparatus is shown as it would appear in use. A partial view of the lower section 6 of a wall mounted toilet 4 with the platform 10 supporting the lower section 6 of the wall mounted toilet 4 is shown. Three adjustable base members 9 with mounting bolts 12 and feet 16 are visible in this view. The adjustable base members 9 are adjusted by rotating them in the threaded bore 23 so that the feet 16 are connected solidly with the floor 2 and the platform 10 is connected firmly with the lower section 6 of the wall mounted toilet 4. In this view a single wall mount 22 is shown which affixes the toilet 4 to the wall. The toilet support apparatus does not attach to the wall mount 22 of the wall mounted toilet 4 unlike the SK1000 support described above. Furthermore, there is no need for vertical stabilization arms as in the BTSS support described above. The mounting bolts 12 can be of different heights in order to adjust for the height of the wall mounted toilet 4 and for any slope of the floor. In FIG. 4, covers or pads are not shown but can be used on one or more of the feet 16.

Figure 5:
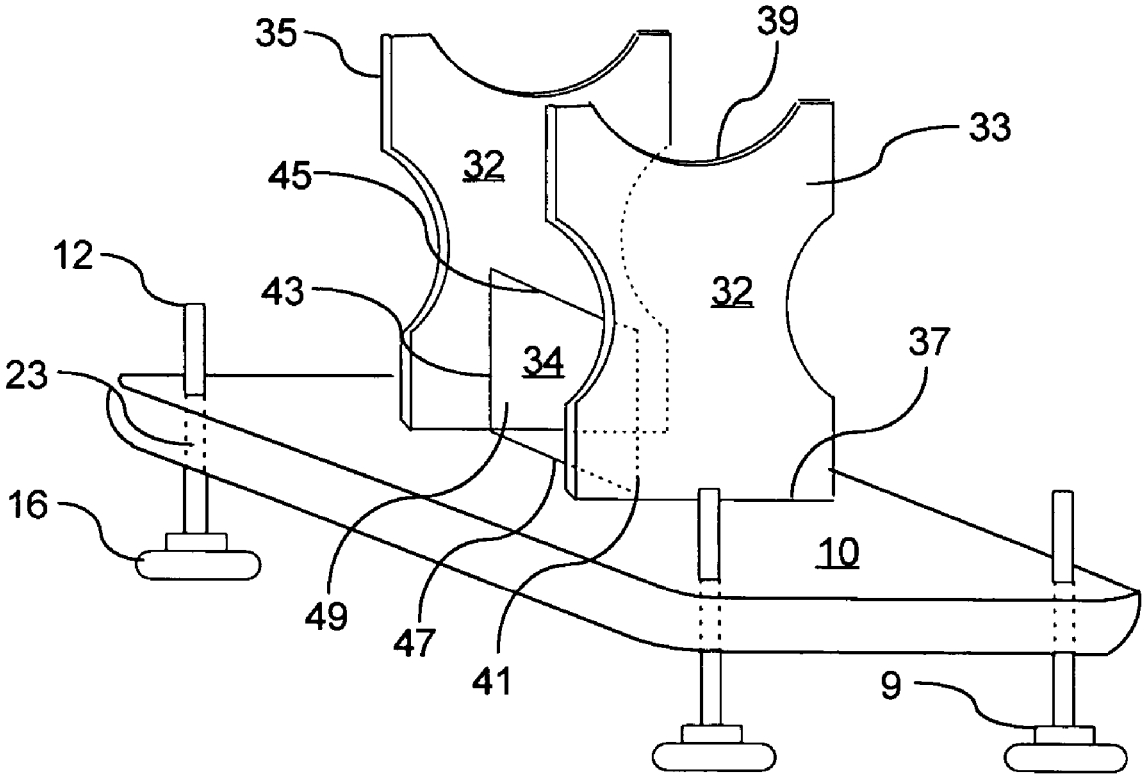
FIG. 5 shows an oblique view of an alternate embodiment of the toilet support.

In FIG. 5, an alternate version of the toilet support apparatus is shown in a stand alone oblique view. This version supports wall mounted toilets with rounded bottoms. The toilet support apparatus previously described in FIG. 1 through FIG. 4 can be used with a wall mounted toilet that has a rounded lower section but a smaller area of contact between the wall mounted toilet and the toilet support apparatus occurs. The alternate version provides a greater area of contact between the wall mounted toilet and the toilet support apparatus. Two support members 32 are shown with a connecting member 34. The support members 32 have a front surface 33 and a back surface 35 that are spaced from each other by bottom edges 37 and top edges 39 The top edges 39 of the support members 32 are curved, exemplarily in a saddle shape, and are configured to cradle the rounded lower section of the wall mounted toilet and provide additional area for the lower section 6 of the wall mounted toilet 4 to contact the toilet support apparatus. The exemplary bottom edges 37 are configured to facilitate welding to the platform 10, and in the exemplary embodiment both the platform 10 and the bottom edge 37 are accordingly flat. The support members 32 and the connecting member 34 are welded together and are welded to the platform 10. The support members 32 are of different heights to accommodate the curved shape of a rounded lower section of the wall mounted toilet. The mounting bolts 12 and feet 16 of the adjustable base members 9 are shown and are inserted through the threaded bore 23 in the platform 10. In the preferred embodiment two support members 32 and a single connecting member 34 are used to add sufficient weight or force bearing capacity. Additional support members 32 and connecting members 34 can be added. The connecting member 34 has a front edge 41, rear edge 43, top edge 45, bottom edge 47, and two side surfaces 49 where the front edge 41 is connected to a more forwardly disposed (front) vertical support member 32, the rear edge is connected to a more rearward disposed (rear) vertical support member 32 and the bottom edge 47 is connected to the platform 10. All connections between the support members 32, the connecting member 34 and the platform 10 are preferably welds.

Figure 6:
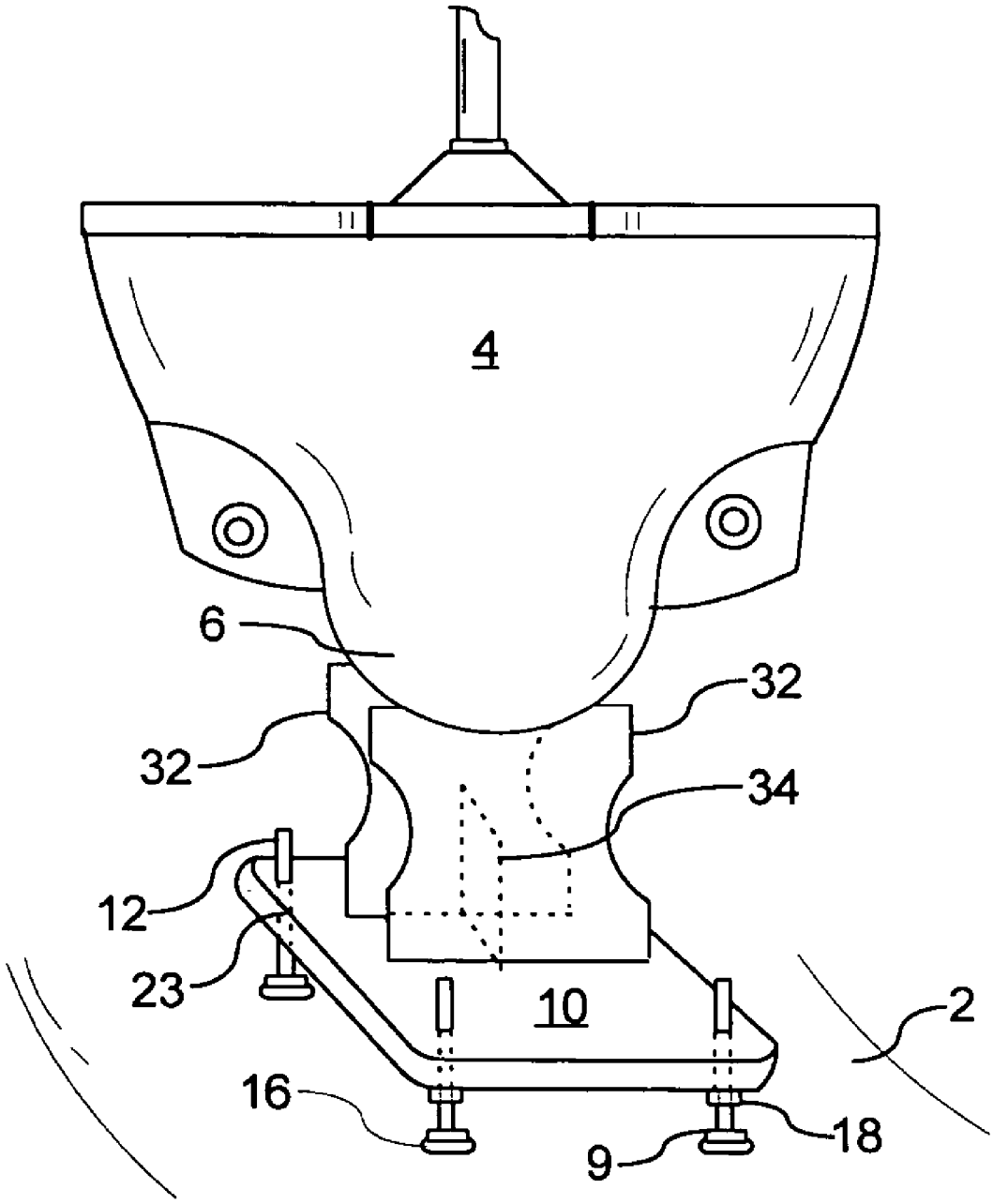
FIG. 6 shows a perspective view of an alternate embodiment of the toilet support in use with a wall mounted toilet.

In FIG. 6 an alternate version of the toilet support apparatus, as it is used on a rounded bottom, wall mounted toilet, is presented in perspective view. In this example, the wall mounted toilet 4 has a rounded lower section 6. The platform 10 contains two support members 32 which are welded to the platform 10 with a connecting member 34 welded to the support members 32 and stabilizing them. Adjustable base members 9 inserted through threaded bores 23 in the platform 10 comprise mounting bolts 12 and feet 16 and are shown along with the optional securing member 18, shown here as adjusting nuts. The feet 16 remain in contact with the floor 2. To use this version on rounded bottom, wall mounted toilets 4, the device is placed under the wall mounted toilet and adjusted so the support members 32 are positioned directly under the rounded lower section 6 of the wall mounted toilet 4. The adjustable base members 9 are then adjusted by hand until the support members 32 cradle the rounded lower section 6 of the wall mounted toilet 4 and then are adjusted using a wrench to create a firm connection. When the optional securing members 18 are nuts they can be adjusted using a wrench until they are firmly positioned under the bottom of the platform 10.

Figure 7:
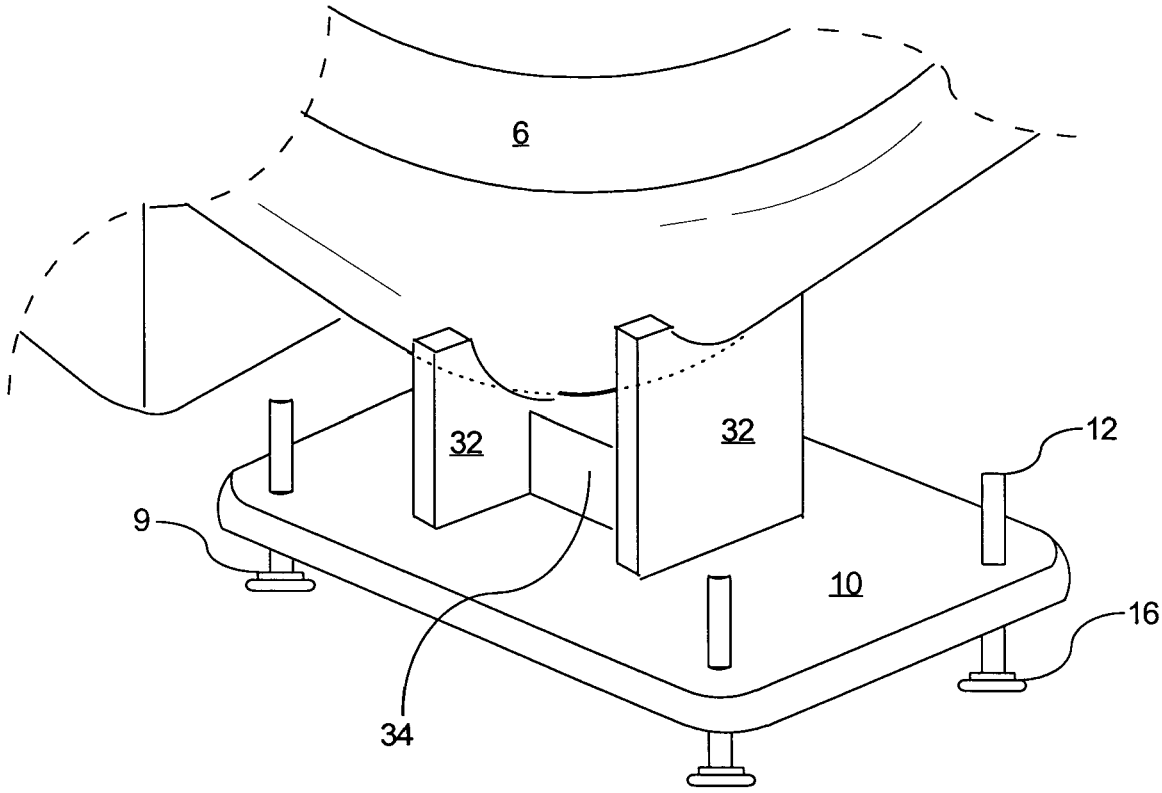
FIG. 7 shows an oblique view of the alternate toilet support as it is placed under a partial view of a wall mounted toilet.

FIG. 7 shows an oblique view of the alternate version of the toilet support apparatus as it is in use with a partial view of the rounded lower section 6 of a wall mounted toilet. The two support members 32 are shown with the connecting member 34 between the support members 32. The support members 32 are of different heights to accommodate the curved shape of a rounded lower section 6 of the wall mounted toilet. The mounting bolts 12 and feet 16 of the adjustable base members 9 are shown.

Continuing with the embodiments described above, an alternative can include a wrench mount on the platform and a wrench with the proper span for the mounting bolts and nuts. This provides the user with the ability to place the support quickly and without the need to search for the right tool. The wrench can be of any commercially available type, preferably having a fixed span fitted to the size of the adjustable base member and the optional securing members and more preferably having a ratcheting action due to the confined nature of the space. The wrench and its mount are placed outside of the contact area between the platform and the bottom surface of the wall mounted toilet, preferably along a side of the platform.

In an alternate embodiment, the platform has one or more levels mounted to its top surface including a simple bull's-eye bubble level as is commonly used in construction and on tripod stands. The optional level is used where the floor is determined to be level and a level toilet support is desired. The level or levels are fixed to the top surface of the platform, outside of the contact area between the platform and the bottom surface of the wall mounted toilet.

The toilet support provides additional weight bearing capacity for wall mounted toilets beyond their rated failure point. For many wall mounted toilets, the rated load is between 250 and 350 pounds. When a weight or force greater than this rating is placed on the wall mounted toilet, the toilet may pull away from the wall or crack near the wall mounts, possibly injuring the user and necessitating costly repair or replacement and downtime for the bathroom and/or hospital room. By placing the toilet support properly under the wall mounted toilet, the risk of damage to the toilet is reduced as the force or weight load of the toilet is increased.

Testing of the toilet support with weights has demonstrated that the support can bear a load of well over five hundred pounds, above the normal weight limit of the fixture and well within the weight range for overweight, obese and severely obese persons.

I claim:

1. A toilet support apparatus for use with a wall mounted toilet positioned above a floor comprising;

a weight distributing platform having a top surface, a bottom surface separated by an outside edge, the platform being of a thickness such that said support apparatus may be placed between the lower section of the wall mounted toilet and the floor;

at least two vertical support members of a height to communicate force from said toilet to said platform by contacting both, each comprising:

a curved top edge, a front surface, a back surface, and a flat bottom edge where said bottom edge is attached to said platform; and at least four adjustable base members integral to said platform for engaging said floor surface, each base member comprising:

a threaded mounting rod, a foot, and an adjusting member that are configured such that said support members rest in a substantially parallel manner with said bottom surface of said wall mounted toilet and said foot rests in a substantially parallel manner with said floor.

2. The toilet support apparatus of claim 1 wherein said vertical support members are connected via a vertical connecting member.

3. The toilet support apparatus of claim 2 wherein said vertical connecting member has a front edge, rear edge, top edge, bottom edge, and two side surfaces where:

said front edge is connected to a front vertical support member; said rear edge is connected to a rear vertical support member and said bottom edge is connected to said platform.

4. The toilet support of claim 1 wherein said vertical support members are of different heights.

5. The toilet support apparatus of claim 1 wherein said adjustable base members each engage a bore in said platform.

6. The toilet support apparatus of claim 1 wherein said adjustable base members are removably threaded into said platform.

7. The toilet support apparatus of claim 1 wherein said adjusting member is a bolt integral on the top surface of said foot.

8. The toilet support apparatus of claim 1 wherein said adjusting member is one or more nuts connected to said threaded mounting rod.

9. The toilet support apparatus of claim 1 wherein said foot contains a floor pad with a non-slip bottom surface connected to the bottom portion of said foot.

* * * * *